United States Patent [19]

Cowan et al.

[11] Patent Number: 4,768,974

[45] Date of Patent: Sep. 6, 1988

[54] POWER CORD RETAINER

[76] Inventors: Joel E. Cowan, 5370 Osceola St., Denver, Colo. 80212; Ted A. Klym, 3539 S. Fairplay Way, No. B-11, Aurora, Colo. 80014

[21] Appl. No.: 106,983

[22] Filed: Oct. 5, 1987

Related U.S. Application Data

[63] Continuation-in-part of Ser. No. 045,299, May 1, 1987, abandoned.

[51] Int. Cl.[4] ..... H01R 13/639

[52] U.S. Cl. ..... 439/371; 439/373; 439/451

[58] Field of Search ..... 439/368, 369, 371, 373, 439/451

[56] References Cited

U.S. PATENT DOCUMENTS

| | | | |
|---|---|---|---|
| 1,143,536 | 6/1915 | Goodridge | 439/373 |
| 2,089,665 | 10/1937 | Roberts et al. | 439/373 |
| 2,569,037 | 9/1951 | Dalton | 439/373 |
| 2,728,058 | 12/1955 | Phalen | 439/371 |
| 2,913,791 | 11/1959 | Martin | 439/369 |
| 3,538,484 | 11/1970 | Passafiume | 439/373 |
| 3,838,383 | 9/1974 | Wilbur et al. | 439/373 |
| 4,066,313 | 1/1978 | von dem Hagen | 439/371 |
| 4,702,709 | 10/1987 | Santilli | 439/373 |

*Primary Examiner*—J. Patrick McQuade
*Attorney, Agent, or Firm*—Charles C. Corbin

[57] ABSTRACT

A combination of components mountable to an electrical outlet cover and to a power cord in proximity to the male plug, for releasably retaining the male plug close to the outlet, and including a hook assembly with a hook portion that extends from a strap portion that has been tightly bound and locked around the power cord at a location near the plug, and a hook retainer adapted to engage an outlet face plate and mounted thereto, and providing a looping opening for engagement by the hook of the hook assembly.

4 Claims, 2 Drawing Sheets

POWER CORD RETAINER

This is a continuation-in-part of application Ser. No. 045,299, filed May 1, 1987, now abandoned.

BACKGROUND

It has been found in many instances that it desirable to releasably hold the end portion of an electrical power cord so that the male plug will not be dislodged from the socket of a power outlet or moved away from the outlet when the power cord is pulled. There is a clear need for preventing unintentional unplugging of power tools and other like equipment used at a work site, since resulting work stoppages hinder productivity. It is also noted that unintentional pulling of a power cord can often cause fracturing and other damage to the plug, which in turn creates a short-circuit hazard. Valuable data, and the work effort expended thereon, can be lost from a computer memory when the computer power line is inadvertently dislodged. In addition, there is certainly concern that life-supporting and otherwise vital medical equipment not be unintentionally unplugged. To overcome these and similar problems one might secure, with a screw fastener for example, the plug to an outlet. This solution however does not lend itself to use with mobile equipment, such as portable tools, that must often be moved from place to place.

It is further noted that there is also occasion for the need for holding the end of an unplugged cord adjacent an electrical outlet. This would be particularly useful with a device that does not have an on-off switch.

SUMMARY OF THE INVENTION

In view of the foregoing it is an object of the present invention to provide means for releasably retaining the unplugged or plugged male plug end of a power cord in the vicinity of an outlet whereby a pulling on the cord will not transfer force to the plug.

Another object is to provide a simple, inexpensive means for releasably holding an end of a power cord to the power outlet structure.

A further object is to provide a cord retainer system having components that can be quickly and easily attached to a power cord and to the face plate of an outlet.

These and other objects and advantages will be recognized and are achievable by those of ordinary skill in the art by reference to the present invention as described in the following summary, detailed description of the drawings, and the claims.

Accordingly, the present invention is a power cord retainer system that includes a hook assembly that can be secured to a cord at a location near the male end, and a hook receiver that is mountable to the face plate of the power outlet. The hook assembly has a strap portion with a locking head and flexible elongate tail which is locatable around the cord and in a tightened loop. A hook extends from the locking head. The invention also includes a hook receiver that is adapted for mounting to a conventional outlet face plate that is secured by a central screw to a terminal box mounted in a building wall. This receiver has a resilient, elongate leg adapted to lie generally flush under the plate and extending just beyond the edge of said plate. There is a hole in one end of the leg for receiving said central screw. The receiver also has a looping portion adjoining the other end of said leg, for receiving the hook. The invention also features a proping post extending from the looping portion, for engaging said wall so as to hold said looping portion at a distance from the wall surface. In one modification of the invention the hook is equipped with a resiliently biased latch for closing the engaging gap of the hook.

DETAILED DESCRIPTION

Figure 1:
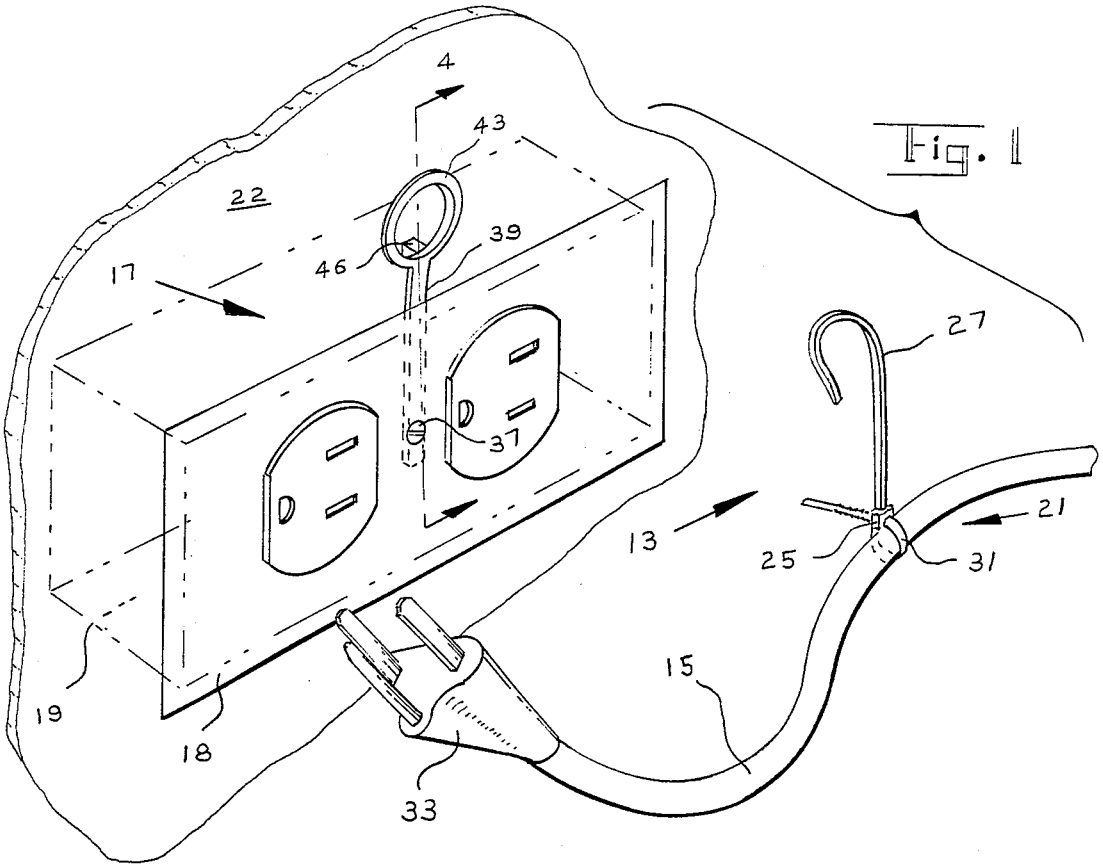
FIG. 1 is a view in perspective showing the cord retainer system of the invention.
Figure 2:
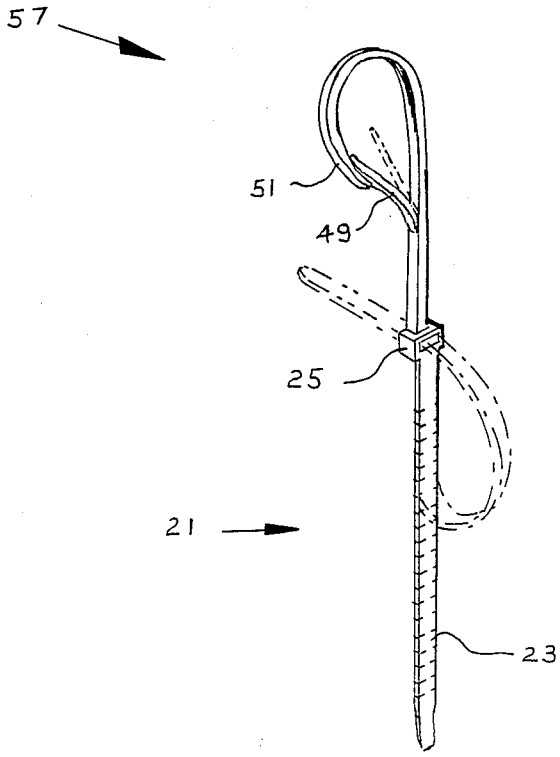
FIG. 2 is an enlarged perspective view of a variant of the hook assembly of the invention, with a portion in phantom for illustrative purposes.
Figure 3:
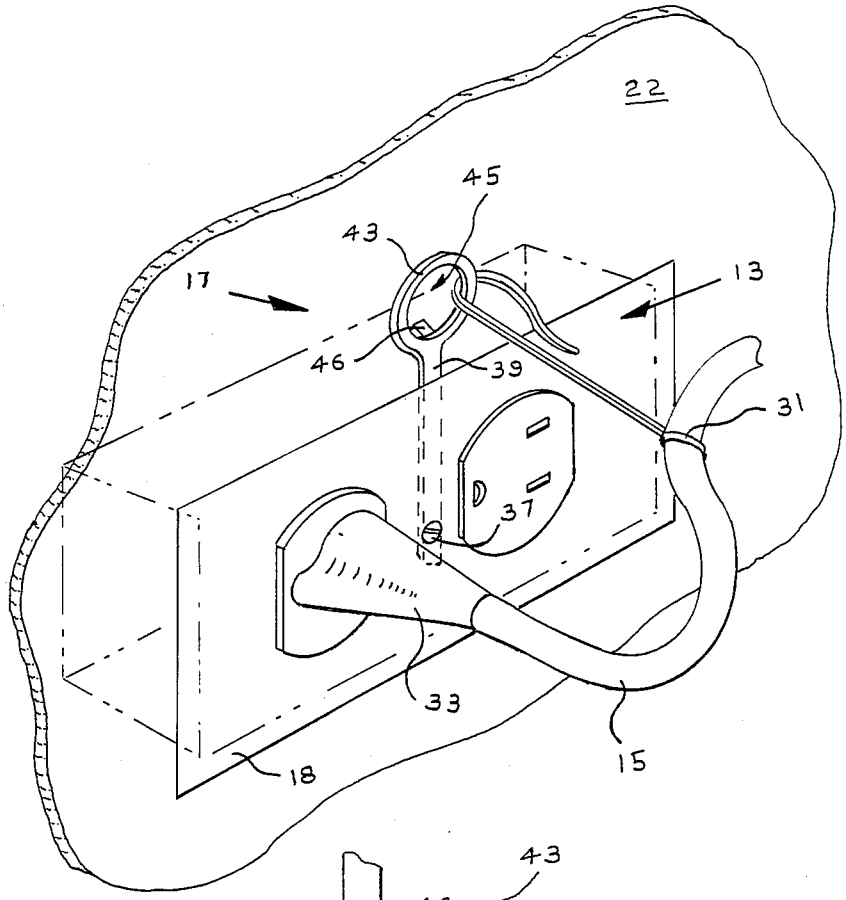
FIG. 3 is a perspective view showing the invention in operation.

Referring now to the drawings FIG. 1 shows the hook assembly 13 of the invention attached to an electric power cord 15, and the hook retainer 17 of the invention mounted to the face plate 18 of a terminal box 19 that is mounted in a wall 22. Hook assembly 13 and retainer 17 are preferably constructed of a plastic material such as nylon which is suited because of its strength, durability and nonconductivity. The lower part of hook assembly 13, as best shown in FIG. 2, is a manually operable cable strap 21, of a conventional design similar to that disclosed in U.S. Pat. No. 3,118,200, with an elongated serrated portion 23 and a locking head 25. A hook portion 27, shown in FIG. 1, extends upwardly from the strap locking head 25, and has a rectangular cross-sectional configuration of a thickness sufficient to provide hook portion 27 with a degree of rigidity compatible with its intended use. Hook assembly 13 is attached to the cord 15 at a location that is spaced a short distance from the male plug 33. It is appreciated that this spacing should be enough to allow male plug 33 to be easily plugged or unplugged when the invention is employed as shown in FIG. 3. Attachment of hook assembly 13 to cord 15 is accomplished when the elongated portion 23 is wrapped around cord 15, through locking head 25 and drawn into binding engagement as a loop 31.

Figure 4:
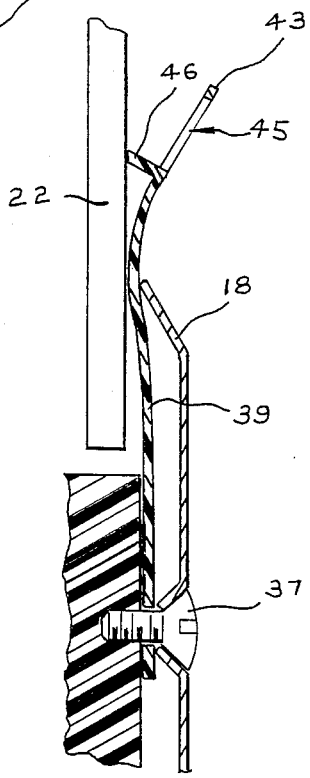
FIG. 4 is an enlarged partial cross-sectional view taken along line 4—4 of FIG. 1.

FIG. 1 shows hook retainer 17 mounted to face plate 18, which is of a standard, widely used design of plastic or metal, and affixed to terminal box 19, mounted in wall 22, by a screw 37. The retainer 17 is preferably constructed of a suitable resilient plastic and has a generally flat leg portion 39 with a hole provided at its lower end for receiving the plate screw 37. A loop 43 adjoins the other end of leg 39 and provides a hook-receiving opening 45. A proping post 46 extends outwardly from the loop 43 at about 90 degrees to leg 39 as shown in FIG. 4.

The hook receiver 17 may be easily and quickly installed in the configuration shown in the drawings. First the screw 37 is unscrewed and plate 18 removed. Receiver leg 39 is then placed between the wall 22 and the inner side of plate 18, with leg 39 extending generally at about 90 degrees to the longer edge of plate 18, and with the lower end of leg 39 aligned for receiving the screw 37. As FIG. 4 shows, when the plate 18 is reattached by screw 37, the upper portion of leg 39 is urged against the surface of wall 22 by the edge of plate 18. Thus the post 46 will engage wall 22 and urge the loop 43 to a position away from the wall. This makes it convenient for the opening 45 to be engaged by hook 13. It is preferred that the foot of post 46 have a surface which is oriented, as illustrated in FIG. 4, to lie flush with the surface of wall 22.

The complementary component of the invention, the hook assembly 13 may next be connected to cord 15 in the manner afore-described. The hook assembly 13 may then be mounted to the retainer 17 as illustrated in FIG. 3. Thusly installed, the thrust of any inadvertent tugging on cord 15 will be absorbed by the combined components of the invention, and the plug 33 will be undisturbed. When it is desirable that the unplugged plug 33 be conveniently retained adjacent the terminal 19 the components of the invention are left in their hooked configuration.

In a variant of the invention shown in FIG. 2, the hook assembly 57 includes a toggle 49 which is resiliently biased into contact with hook portion 51 and manipulable to the hook-opening configuration illustrated by phantom lines in FIG. 2. The lower portion of this variant is the same as that of the afore-described embodiment.

While there has been described particular embodiments of the invention, it will be obvious to those skilled in the art that various changes and modifications may be made therein without departing from the invention and, therefore it is aimed to cover all such changes as fall within the true spirit and scope of the invention.

What is claimed is:

1. Apparatus for releasably retaining the male plug end of a power cord in the vicinity of an electrical outlet, which outlet includes a face plate secured at a central portion thereof by a screw fastener to a terminal box mounted in a building wall, said apparatus comprising:

a. hook assembly having a strapping portion comprising a locking head and elongated flexible serrated strap extending therefrom, said strap adapted to be wrapped around said cord and drawn through said locking-head so as to make binding engagement with said cord, and a hook portion extending from said locking-head; and b. hook receiver, having a generally flat, resilient leg with a hole extending through a first end portion thereof for receiving said screw fastener, and said leg adapted to extend beyond an edge of said face plate, and a closed loop adjoining the second end portion of said leg, and a post extending from said receiver, at a location in the vicinity of said loop, and said post adapted to engage said wall whereby said loop is urged to a position away from the surface of said wall.

2. Apparatus as defined in claim 1 wherein said post depends from said loop.

3. Apparatus as defined in claim 1 wherein said post depends from said leg.

4. Apparatus as defined in claim 1 wherein said hook portion includes a resiliently biased toggle for releasably enclosing the grasping gap of said hook portion.

* * * * *